US006866104B2

(12) United States Patent
Stoesz et al.

(10) Patent No.: US 6,866,104 B2
(45) Date of Patent: Mar. 15, 2005

(54) DROP IN DART ACTIVATED DOWNHOLE VIBRATION TOOL

(75) Inventors: Carl W. Stoesz, Houston, TX (US); Joe DeGeare, Houston, TX (US); Gerald D. Lynde, Houston, TX (US); Roy E. Swanson, Sugarland, TX (US); James A. Sonnier, Houston, TX (US); David B. Haughton, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 16 days.

(21) Appl. No.: 10/353,795

(22) Filed: Jan. 28, 2003

(65) Prior Publication Data

US 2003/0168227 A1 Sep. 11, 2003

Related U.S. Application Data

(60) Provisional application No. 60/353,391, filed on Jan. 31, 2002.

(51) Int. Cl.[7] ..... E21B 7/00

(52) U.S. Cl. ..... 173/1; 173/90; 173/91; 173/136

(58) Field of Search ..... 173/1, 90, 91, 173/19, 135, 136; 166/177.6, 301; 175/295, 297, 299

(56) References Cited

U.S. PATENT DOCUMENTS

| | | | | |
|---|---|---|---|---|
| 3,361,220 A | | 1/1968 | Brown | |
| 3,392,795 A | * | 7/1968 | Greer | 175/297 |
| 3,735,827 A | * | 5/1973 | Berryman | 175/296 |
| 4,361,195 A | * | 11/1982 | Evans | 175/297 |
| 4,566,546 A | * | 1/1986 | Evans | 175/297 |
| 5,007,479 A | * | 4/1991 | Pleasants et al. | 166/178 |
| 5,086,853 A | * | 2/1992 | Evans | 175/297 |
| 5,174,393 A | * | 12/1992 | Roberts et al. | 175/297 |
| 5,318,139 A | * | 6/1994 | Evans | 175/297 |
| 5,447,196 A | * | 9/1995 | Roberts | 166/178 |
| 5,595,244 A | * | 1/1997 | Roberts | 166/178 |
| 5,624,001 A | * | 4/1997 | Evans | 175/299 |
| 5,803,182 A | * | 9/1998 | Bakke | 173/91 |
| 5,875,842 A | * | 3/1999 | Wyatt | 166/178 |
| 6,152,222 A | | 11/2000 | Kyllingstad | |
| 6,182,775 B1 | | 2/2001 | Hipp | |

FOREIGN PATENT DOCUMENTS

| | | |
|---|---|---|
| EP | 1 239 112 A2 | 9/2002 |
| GB | 2 364 080 A | 1/2002 |

* cited by examiner

*Primary Examiner*—Rinaldi I. Rada
*Assistant Examiner*—Chukwurah Nathaniel
(74) *Attorney, Agent, or Firm*—Gerald W. Spinks

(57) ABSTRACT

A downhole vibration tool consisting of a body assembly installed in a work string, and a drop-in dart valve assembly. An open inner bore through the body assembly allows the performance of operations through the body assembly. To activate the vibration tool, the dart valve assembly is dropped into the work string and pumped downhole into engagement with the body assembly. Once the dart valve assembly is in place in the body assembly, continued pumping of fluid will cause the tool to begin to vibrate longitudinally. When the jarring operation is finished, the dart valve assembly can be released from the body assembly and retrieved, with a wireline or coiled tubing unit.

14 Claims, 3 Drawing Sheets

DROP IN DART ACTIVATED DOWNHOLE VIBRATION TOOL

CROSS REFERENCE TO RELATED APPLICATIONS

This application relies upon U.S. Provisional App. No. 60/353,391, filed Jan. 31, 2002, for "Drop In Dart Activated Downhole Vibration Tool".

STATEMENT REGARDING FEDERALLY SPONSORED RESEARCH OR DEVELOPMENT

Not Applicable

BACKGROUND OF THE INVENTION

1. Field of the Invention

The present invention relates to an improved downhole jar apparatus that delivers upward blows, and which is activated by pumping an entire dart valve assembly downhole through a tubing string or work string to land in a vibratory tool body assembly.

2. Background Art

In downhole well operation, there is often a need to perform longitudinal jarring, or vibratory impact, operations. For example, such a jarring operation is often used during work-over operations, using a pipe string or work string such as a coil tubing unit or snubbing equipment. In particular, during fishing operations, it is sometimes necessary to apply upward jarring forces near the bottom of the work string, if the fishing tool becomes stuck.

It is known to operate a jarring device by fluid pressure acting on a dart valve and piston, to urge the dart valve and piston longitudinally in the downhole direction until the downhole movement of the dart valve is stopped. When the downhole movement of the dart valve stops, the seal between the dart valve and the piston is broken, and both the dart valve and the piston move longitudinally in the uphole direction. That is, when the dart valve unseats, the dart valve and the piston both move uphole under spring pressure. This causes the piston to strike some sort of downwardly facing anvil surface in the housing of the tool. It is also known to activate the dart valve mechanism by pumping a device such as a ball downhole, to plug a fluid flow path in the dart valve assembly.

In all such known devices, both the piston and at least part of the dart valve assembly are permanent components of the jarring apparatus, which is installed as a permanent part of the work string. Because the dart valve operates by stopping fluid flow through the jarring apparatus, its permanently installed mechanism necessarily occupies a substantial portion of the inner bore of the jarring apparatus. This presence of the dart valve mechanism in the inner bore of the apparatus necessarily restricts access through the dart valve portion of the apparatus, which can prevent the performance of some operations below the jarring tool, such as free-point measurements, gravel packing operations, drilling operations, fishing operations, or other wireline or coil tubing operations.

For example, U.S. Pat. No. 3,361,220 to Brown discloses a dart valve assembly consisting of a drop-in dart valve V and a valve seat 12*b* in the jarring mechanism A. The jarring mechanism A, which includes the valve seat, is permanently installed in the work string. The valve seat, considerably smaller than the bore of the work string, restricts access through the jarring apparatus to any portion of the well bore below the tool. It should also be noted that the drop-in portion V of the dart valve assembly is not latched into the tool, leaving it free to fly upwardly an undefined distance at each stroke of the tool. Further, it should be noted that the dart valve V does not have a limited downward travel, so it simply rides downwardly with the piston 12 until the piston bottoms out, or until the fluid pressure equalizes against the piston return spring pressure. This increases wear on the piston return spring and reduces the predictability of each valve cycle.

The existence of a sufficiently open bore through the jarring apparatus to allow the performance of the aforementioned types of operations through the bore is a goal of the present invention. As used herein, an "open bore" through the apparatus should be understood to mean that the inner bore of the dart valve portion of the jarring apparatus is unrestricted, at least to a diameter matching the diameter of the inner bore through the piston portion of the jarring apparatus.

Therefore, it is desirable to have a jarring apparatus which can be installed in the work string with essentially an open bore, but which can be converted to an effective jarring apparatus when required. It is also desirable to be able to return the jarring apparatus to the open bore condition after performance of the jarring operation.

BRIEF SUMMARY OF THE INVENTION

The downhole vibration tool of the present invention consists of two main components, the body assembly and the dart valve assembly. The body assembly is initially installed in the work string before the work string is lowered into the well bore. An open inner bore through the body assembly allows the performance of operations through the body assembly, such as free-point measurements, gravel packing operations, drilling operations, fishing operations, or other wireline or coil tubing operations. To activate the vibration tool, the dart valve assembly is dropped into the work string and pumped downhole into engagement with the body assembly. Once the dart valve assembly is in place in the body assembly, continued pumping of fluid will cause the tool to begin to vibrate longitudinally.

The body assembly includes a piston and its associated return spring, which generate the desired longitudinal vibrations when activated by the dart valve assembly. The dart valve assembly includes the valve components necessary to operate the tool. After the dart valve assembly lands in the body assembly, fluid flow pressure causes the dart valve mechanism to seat, which blocks fluid flow through the piston. This creates a fluid pressure differential which moves the piston in the downhole direction, compressing the piston return spring. At full stroke of the tool, the dart valve mechanism unseats. This equalizes pressure and allows the piston to be returned by its associated spring to impact against a shoulder in the body assembly, causing a jarring reaction in the uphole direction. Continued pumping of fluid through the work string causes the rapid repetition of this process, which generates the desired longitudinal vibrations in the work string.

When the jarring operation is finished, the dart valve assembly can be released from the body assembly and retrieved, with a wireline or coiled tubing unit. Releasing and retrieving the dart valve assembly is accomplished with a standard fishing spear inside a collar designed to release the dart assembly from the body assembly.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
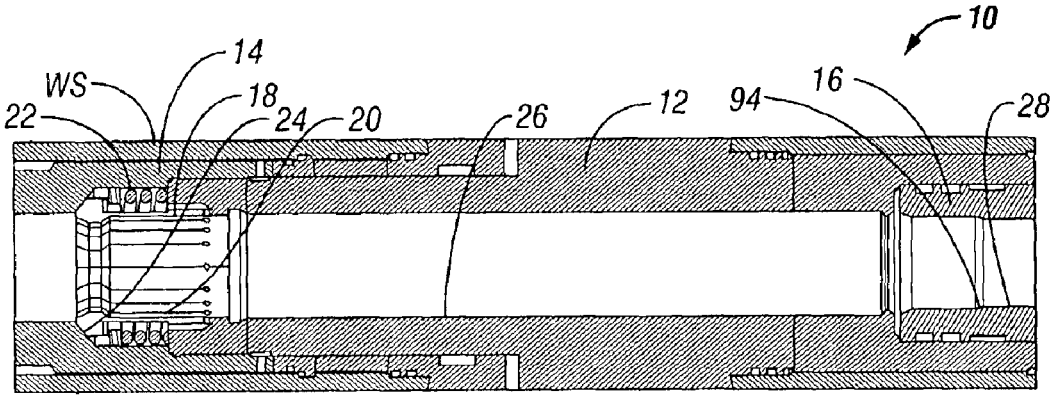
FIG. 1 is a longitudinal section view of a body assembly according to the present invention, installed in a work string.
Figure 2:
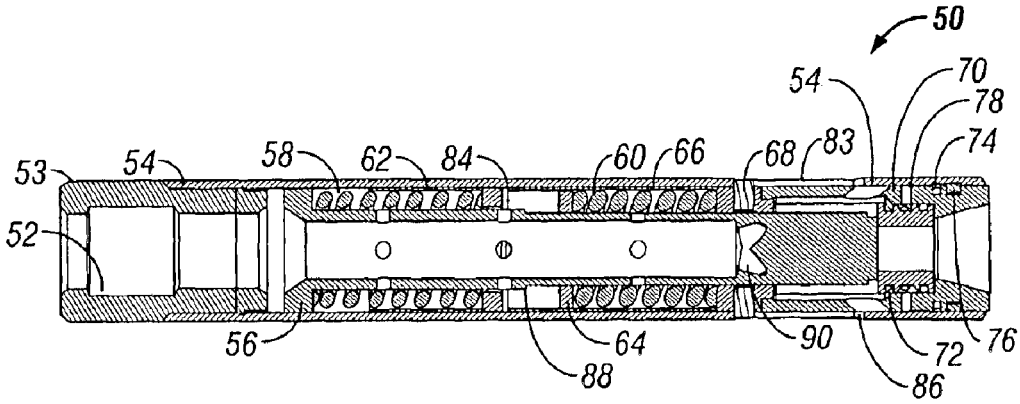
FIG. 2 is a longitudinal section view of a dart valve assembly according to the present invention, ready for pumping downhole.

The drop in dart activated vibration tool of the present invention includes two main components: the body assembly 10 shown in FIG. 1, and the dart assembly 50 shown in FIG. 2. The body assembly 10 is shown in FIG. 1 as it is installed in the work string WS for running into the well bore. The body assembly 10 includes a body mandrel 12, and an upper sub 14. Further, a piston 16 is slidably disposed in the lower end of the body mandrel 12. The piston 16 is biased in the uphole direction by a return spring (not shown), as is known in the art. The terms "upward", "uphole", and similar terms, should be understood to have the same connotation herein, and the terms "downward", "downhole", and similar terms, should be understood to have the same connotation, since the apparatus of the present invention can be used in a well bore which may or may not be vertical. A collet 18 is disposed in the upper end of the body mandrel 12 and the lower end of the upper sub 14. The fingers of the collet 18 are biased slightly inwardly in the installed condition, to project slightly into the inner bore. The inward bias of the collet fingers is assisted by a coil spring 22 which forces the inwardly sloped upper ends of the collet fingers against a conical surface 24 in the upper sub 14, which is angled inwardly toward the inner bore. This spring preload of the collet 18 takes up the clearance of the assembly, to resist the vibration forces.

As it is installed in the work string WS, the body assembly 10 has an open inner bore 26 through the body mandrel 12 which essentially matches the inner bore 28 of the piston 16. The collet 18 also has an open inner bore 20 which substantially matches the inner bore 28 of the piston 16. It can be seen that the open inner bores 20, 26 through the body assembly 10 are of sufficient diameter to allow the performance of operations through the body assembly 10, such as free-point measurements, gravel packing operations, drilling operations, fishing operations, or other wireline or coil tubing operations.

The dart valve assembly 50, as seen in FIG. 2, contains the valve components necessary to operate the tool. This dart valve assembly 50 has a length and outside diameter which will allow it to be pumped downhole through the work string. The dart valve assembly 50 includes a fishing neck profile 52 in an upper sub 53, a housing 54, and a dart valve 56 slidingly disposed within the housing 54. Upper and lower dart valve springs 58,60 bias the dart valve 56 upwardly. A plurality of dart valve ports 90 in the lower portion of the dart valve 56 equalize fluid pressure between the inside and the outside of the dart valve 56.

A spring sleeve 62, slidingly disposed within the housing 54, surrounds the upper dart valve spring 58. A valve guide 66, also slidingly disposed within the housing 54, surrounds the lower dart valve spring 60 and guides the lower end of the dart valve 56. A washer 64, disposed inside the valve guide 66, between the upper dart valve spring 58 and the lower dart valve spring 60, slidingly surrounds the dart valve 56 below the downwardly facing shoulder 88. The valve guide 66 slides longitudinally within the housing 54, guided by at least one retaining screw 68 riding in at least one longitudinal slot 83 in the housing 54. The lower end 86 of the slot 83 limits the downward travel of the retaining screw 68 and the valve guide 66.

Figure 5:
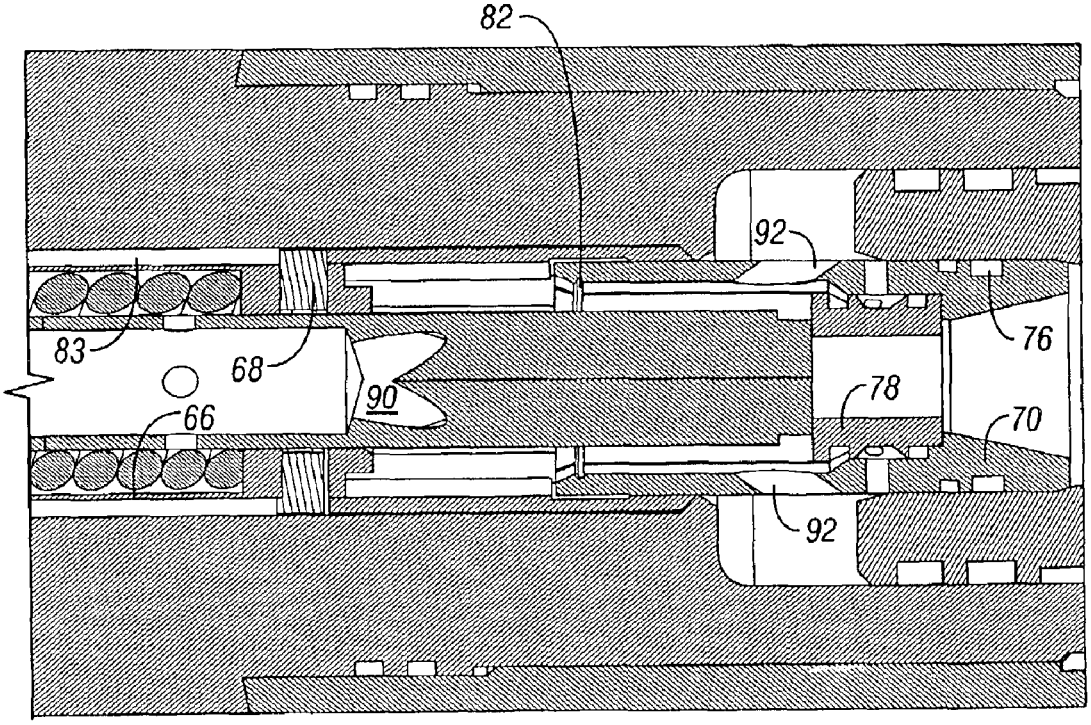
FIG. 5 is a longitudinal section view of the apparatus shown in FIG. 4, showing additional details of the dart valve assembly.
Figure 6:
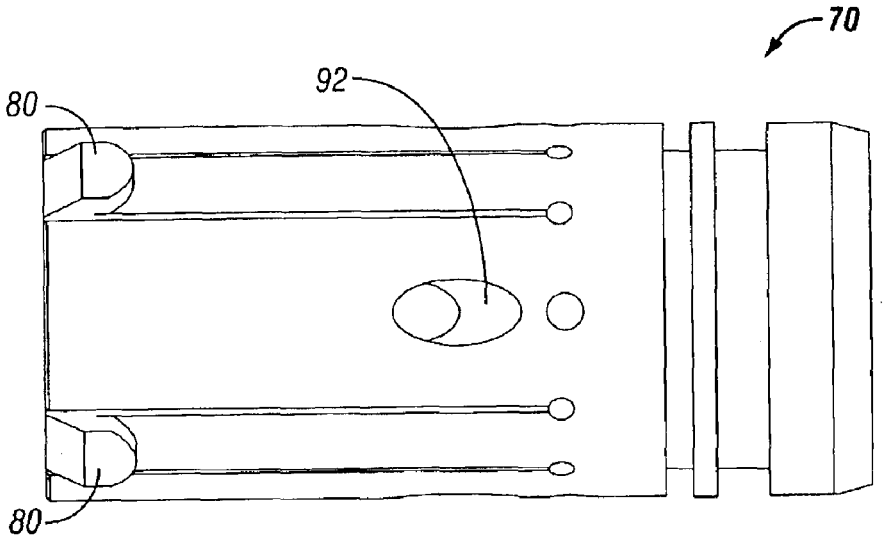
FIG. 6 is an elevation view of one embodiment of a dart valve assembly seat sleeve which can be incorporated in the apparatus shown in FIGS. 2 through 5.

A seat sleeve 70 is slidingly disposed within the lower end of the housing 54 below the dart valve 56. A seal 74 seals the outside of the seat sleeve 70 against the inside of the housing 54, and a snap ring 76 holds the seat sleeve 70 in place in the lower end of the housing 54. A plurality of seat sleeve ports 92, best seen in FIG. 5, equalize fluid pressure between the inside of the seat sleeve 70 above the valve seat 78, and the outside of the seat sleeve 70 above the seal 74. The seat sleeve 70, as shown in FIG. 6, is retained in the housing 54 by means of outwardly projecting dogs 80 that ride in slots in the housing 54. A retaining ring 82, shown in FIG. 5, aids in preventing the dogs 80 from collapsing inwardly. A valve seat 78 is fixedly mounted in the bore of the seat sleeve 70. At least one seal 72 seals the outside of the valve seat 78 against the inside of the seat sleeve 70.

As shown in FIG. 2, the dart assembly 50 is in the "pump in" condition. The nose of the seat sleeve 70 is held within the housing 54 by means of the snap ring 76. Keeping the nose of the seat sleeve 70 inside the housing 54 shortens the overall length of the dart valve assembly 50 and protects the seal 74 as the dart valve assembly 50 travels down the work string WS. It can be seen from FIG. 2 that, in this condition, the dart valve 56 is free to slide downwardly against the valve seat 78, without compressing either the upper dart valve spring 58 or the lower dart valve spring 60. That is, the lower end of the dart valve 56 is shown contacting the valve seat 78, but the lower end of the spring sleeve 62 is not abutting the upper end 84 of the valve guide 66, so the upper spring 58 is not compressed. Further, the washer 64 is not abutting the shoulder 88, so the lower spring 60 is not compressed.

Figure 3:
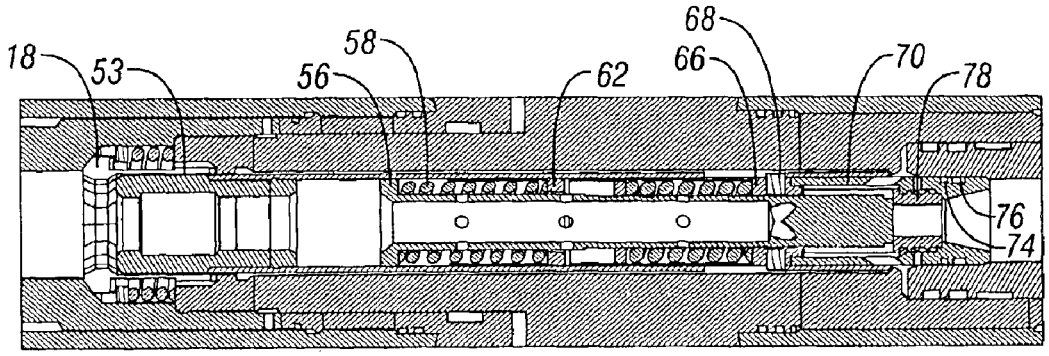
FIG. 3 is a longitudinal section view of the dart valve assembly of FIG. 2 landed in the body assembly of FIG. 1.

To activate the downhole vibration tool of the present invention, the dart assembly 50 is dropped into the inner bore of the work string WS and pumped into place in the inner bore of the body assembly 10. The upper end of the dart valve assembly 50 latches into the spring-loaded collet 18 after it lands in the body assembly 10, as shown in FIG. 3. It can be seen that the fingers of the collet 18 expand to allow passage of the dart valve assembly 50 then contract to capture the upper end of the dart valve assembly, such as by latching over the upper end of the dart valve sub 53. Once the dart valve assembly 50 is latched in place, the tool will begin to operate.

After the dart valve assembly 50 lands in the body assembly 10, continued fluid pressure causes the dart valve 56, the seat sleeve 70, and the valve seat 78 to move downwardly, releasing the snap ring 76 from its groove in the housing 54. These components continue downwardly, moving the lower end of the seat sleeve 70 into the piston 16, were the seat sleeve 70 comes to rest on a shoulder 94 in the piston 16, as seen best in FIG. 1. Alternatively, the snap ring 76 can latch into a groove (not shown) in the piston 16. In this condition, the seat sleeve seal 74 seals the outside of the seat sleeve 70 against the inside of the piston 16.

It can be seen from FIG. 3 that, as the dart valve 56 is pumped downwardly, it forces the upper dart valve spring 58 downwardly against the spring sleeve 62, which in turn moves downwardly, contacting the upper end 84 of the valve guide 66 and moving the retaining screw 68 to the lower end 86 of the slot 83 in the housing 54. This begins compression of the upper dart valve spring 58. As the dart valve 56 continues downwardly under fluid pressure, the shoulder 88 contacts the washer 64, beginning compression of the lower dart valve spring 60. Seating of the lower end of the dart valve 56 against the valve seat 78 blocks fluid flow through the valve seat 78, which blocks fluid flow through the piston 16. This creates a fluid pressure differential on the dart valve 56 and the valve seat 78, and the resultant force is transferred to the piston 16 via the seat sleeve 70. Further, fluid flow communication through the equalization ports 90 in the dart valve 56 and through the equalization ports 92 in the seat sleeve 70 bypasses the valve seat 78 and exerts fluid pressure directly on the top of the piston 16.

Figure 4:
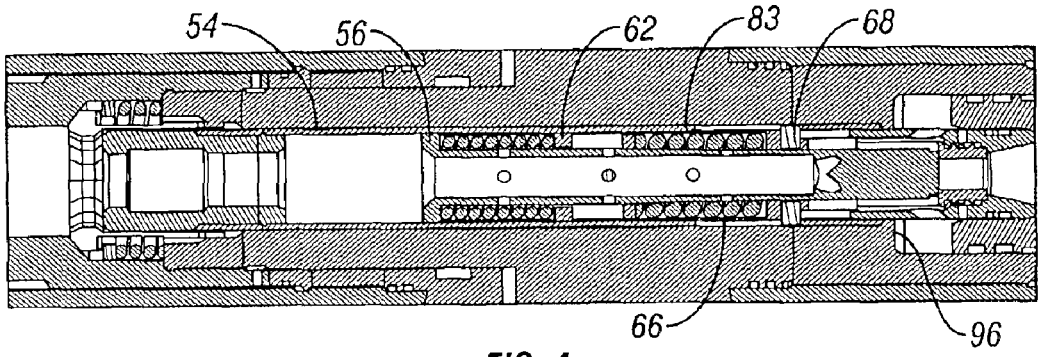
FIG. 4 is a longitudinal section view of the dart valve assembly of FIG. 2 landed in the body assembly of FIG. 1, with the dart valve and the piston at full stroke.

Because of the force from this fluid pressure directly on the piston 16 and the force from the pressure differential on the dart valve 56 and on the valve seat 78, the piston 16 moves in the downhole direction, compressing the piston return spring. At full stroke of the tool, as shown in FIGS. 4 and 5, the dart valve 56 comes to rest against the upper end of the spring sleeve 62, which abuts the upper end of the valve guide 66, which is prevented from further downward movement by abutment of the retaining screw 68 with the lower end 86 of the slot 83 in the dart valve assembly housing 54. When movement of the dart valve 56 is thusly stopped, the continued fluid pressure on the top of the piston 16 and the valve seat 78 forces the piston 16 and valve seat 78 away from the lower end of the dart valve 56, and causes a loss of the seating force of the dart valve 56 against the valve seat 78. This equalizes the pressure differential across the valve seat 78. This allows the dart valve 56 to be returned in the uphole direction by the action of the upper and lower dart valve springs 58,60.

At the same time, the piston 16 is returned by its associated spring to impact against a shoulder 96 in the body assembly 10, causing a jarring reaction in the uphole direction. Continued pumping of fluid through the work string WS causes the dart valve 56 to move downhole again, seating against the valve seat 78 again, with the result that the piston 16 is again forced in the downhole direction until motion of the dart valve 56 is again stopped. Rapid repetition of this process generates the desired longitudinal vibrations in the work string.

Figure 7:
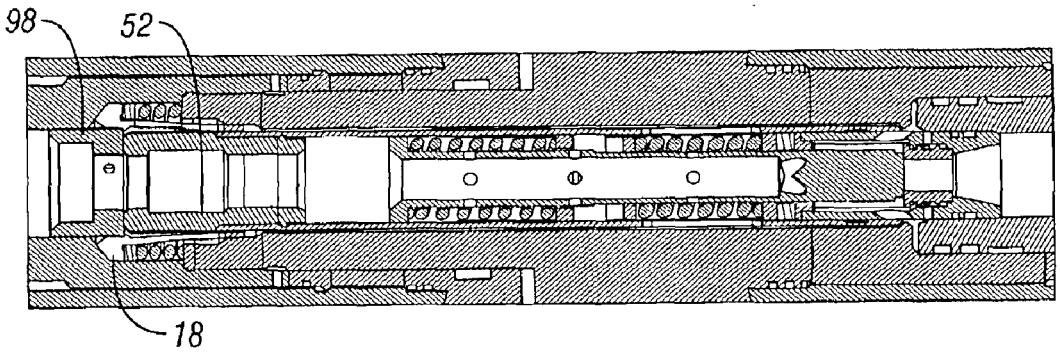
FIG. 7 is a longitudinal section view of the dart valve assembly of FIG. 2 landed in the body assembly of FIG. 1, showing one type of apparatus which can be used to release the body assembly collet to allow retrieval of the dart valve assembly.

When the jarring operation is finished, the dart valve assembly 50 can be released from the body assembly 10 and retrieved, with a wireline or coiled tubing unit. Releasing and retrieving the dart valve assembly 50 is accomplished with a standard fishing spear (not shown) inside a release collar 98 designed to release the dart valve assembly 50 from the body assembly 10, as shown in FIG. 7. The release collar 98 has the same outside diameter as the dart valve assembly 50. As shown in FIG. 7, when run into the apparatus with a spear, the release collar 98 spreads the fingers of the collet 18 to release the dart valve assembly 50 from the body assembly 10, as the spear engages the fishing neck profile 52 inside the upper sub 53 of the dart valve assembly 50. The dart valve assembly 50 can then be withdrawn from the body assembly 10.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. A downhole vibration tool, comprising:

a hollow tool body adapted for lowering into a well bore;

a longitudinally slidable hollow piston mounted in an inner bore within said tool body, said piston having an inner bore, said piston being biased in a first longitudinal direction;

an inner bore through said tool body substantially matching the diameter of said inner bore through said piston;

an activation assembly adapted to be pumpable downhole through a work string, said activation assembly having an outer diameter sized to allow landing of said activation assembly in said inner bore of said tool body, said activation assembly being adapted to latch in said inner bore of said tool body; and a vibratory mechanism within said activation assembly, said vibratory mechanism being adapted to repetitively apply force on said piston in a second longitudinal direction, said activation mechanism being adapted to repetitively release said force on said piston.

2. The downhole vibration tool recited in claim 1, wherein said first longitudinal direction is upward, and said second longitudinal direction is downward.

3. The downhole vibration tool recited in claim 2, wherein said vibratory mechanism comprises a dart valve adapted to repetitively block and restore fluid flow through said inner bore of said piston to thereby apply and release said downward force on said piston.

4. The downhole vibration tool recited in claim 3, wherein said vibratory mechanism further comprises a dart valve seat adapted to land in said piston, said dart valve being adapted to seat against said dart valve seat to block said fluid flow.

5. The downhole vibration tool recited in claim 4, wherein said vibratory mechanism further comprises a retaining device adapted to stop downward movement of said dart valve.

6. The downhole vibration tool recited in claim 5, wherein said vibratory mechanism further comprises at least one equalization port adapted to apply fluid pressure past said dart valve to an upper end of said piston.

7. The downhole vibration tool recited in claim 6, wherein said vibratory mechanism further comprises at least one dart valve return spring adapted to apply upward bias to said dart valve.

8. The downhole vibration tool recited in claim 1, further comprising a collet within said tool body adapted to latch said activation assembly into said tool body.

9. A method for applying vibrations to a work string, said method comprising:

providing a hollow tool body mounted in a work string, said tool body having a hollow piston mounted in an inner bore thereof, said tool body having an inner bore substantially matching the inner bore of said piston, said piston being biased in a first longitudinal direction;

providing an activation assembly;

pumping said activation assembly downhole through said work string;

landing said activation assembly in said inner bore of said tool body;

latching said activation assembly in place in said inner bore of said tool body;

repetitively and alternatingly applying force on said piston in a second longitudinal direction and releasing said force on said piston, with said activation mechanism.

10. The method recited in claim 9, wherein said first longitudinal direction is upward and said second longitudinal direction is downward.

11. The method recited in claim 10, wherein said alternating application and release of said downward force on said piston comprises repetitively blocking and restoring fluid flow through said inner bore of said piston.

12. The method recited in claim 11, wherein said repetitive blocking and restoring of fluid flow comprises seating a dart valve against a dart valve seat and unseating said dart valve from said dart valve seat.

13. The method recited in claim 12, further comprising stopping downward movement of said dart valve with a retaining device to cause said unseating of said dart valve from said dart valve seat.

14. The method recited in claim 13, further comprising applying fluid pressure past said dart valve to an upper end of said piston.

* * * * *